US011398218B1

(12) United States Patent
Haslam et al.

(10) Patent No.: US 11,398,218 B1
(45) Date of Patent: Jul. 26, 2022

(54) DYNAMIC SPEECH OUTPUT CONFIGURATION

(71) Applicant: United Services Automobile Association (USAA), San Antonio, TX (US)

(72) Inventors: Justin Dax Haslam, San Antonio, TX (US); Robert Wilson Barner, San Antonio, TX (US)

(73) Assignee: United Services Automobile Association (USAA), San Antonio, TX (US)

( * ) Notice: Subject to any disclaimer, the term of this patent is extended or adjusted under 35 U.S.C. 154(b) by 146 days.

(21) Appl. No.: 16/394,210

(22) Filed: Apr. 25, 2019

Related U.S. Application Data

(60) Provisional application No. 62/662,962, filed on Apr. 26, 2018.

(51) Int. Cl.
*G10L 13/033* (2013.01)
*G10L 13/00* (2006.01)

(52) U.S. Cl.
CPC ..... *G10L 13/0335* (2013.01); *G10L 13/00* (2013.01)

(58) Field of Classification Search
CPC ..... G10L 13/00; G10L 13/02; G10L 13/0335; G10L 13/08; G10L 15/00; G10L 15/26; G06N 5/00; G06N 20/00
See application file for complete search history.

(56) References Cited

U.S. PATENT DOCUMENTS

| | | | | |
|---|---|---|---|---|
| 5,544,232 | A | 8/1996 | Baker et al. | |
| 9,172,805 | B1 | 10/2015 | Jayapalan et al. | |
| 9,648,161 | B2 | 5/2017 | Jayapalan | |
| 9,912,811 | B2 | 3/2018 | Jayapalan | |
| 10,084,916 | B2 | 9/2018 | Jayapalan | |
| 2003/0007612 | A1 | 1/2003 | Garcia | |
| 2003/0120489 | A1 * | 6/2003 | Krasnansky | G10L 19/0018 704/235 |
| 2003/0157968 | A1 * | 8/2003 | Boman | H04M 1/72547 455/563 |
| 2003/0172185 | A1 | 9/2003 | Dezonno | |
| 2005/0060158 | A1 * | 3/2005 | Endo | G10L 15/22 704/275 |

(Continued)

FOREIGN PATENT DOCUMENTS

| | | |
|---|---|---|
| WO | WO 2011/000934 | 1/2011 |
| WO | WO 2016/89463 | 6/2016 |

*Primary Examiner* — Daniel C Washburn
*Assistant Examiner* — Sean E Serraguard
(74) *Attorney, Agent, or Firm* — Fish & Richardson P.C.

(57) ABSTRACT

Techniques are described for providing dynamically configured speech output, through which text data from a message is presented as speech output through a text-to-speech (TTS) engine that employs a voice profile to provide a machine-generated voice that approximates that of the sender of the message. The sender can also indicate the type of voice they would prefer the TTS engine use to render their text to a recipient, and the voice to be used can be specified in a sender's user profile, as a preference or attribute of the sending user. In some examples, the voice profile to be used can be indicated as metadata included in the message. A voice profile can specify voice attributes such as the tone, pitch, register, timbre, pacing, gender, accent, and so forth. A voice profile can be generated through a machine learning (ML) process.

20 Claims, 6 Drawing Sheets

(56) References Cited

U.S. PATENT DOCUMENTS

| | | | | |
|---|---|---|---|---|
| 2006/0020471 | A1 | 1/2006 | Ju | |
| 2006/0067252 | A1 | 3/2006 | Jolin et al. | |
| 2007/0223668 | A1 | 9/2007 | Blumenfeld et al. | |
| 2010/0312564 | A1* | 12/2010 | Plumpe | G10L 13/08 704/260 |
| 2011/0119138 | A1 | 5/2011 | Rakers et al. | |
| 2011/0124323 | A1 | 5/2011 | Selph | |
| 2011/0276325 | A1* | 11/2011 | Tatum | G10L 15/07 704/235 |
| 2013/0003943 | A1 | 1/2013 | Munns et al. | |
| 2013/0039482 | A1 | 2/2013 | Selph et al. | |
| 2013/0294593 | A1 | 11/2013 | Xing et al. | |
| 2015/0046164 | A1* | 2/2015 | Maganti | H04M 3/42068 704/260 |
| 2016/0104486 | A1* | 4/2016 | Penilla | G10L 15/005 704/232 |
| 2016/0165045 | A1 | 6/2016 | Jayapalan | |
| 2016/0210960 | A1* | 7/2016 | Kim | H04M 1/72594 |
| 2017/0061955 | A1* | 3/2017 | Gueta | G10L 13/04 |
| 2017/0208175 | A1 | 7/2017 | Jayapalan | |
| 2018/0090126 | A1* | 3/2018 | Peterson | G10L 13/033 |
| 2018/0095713 | A1* | 4/2018 | Rubin | G06Q 10/101 |
| 2018/0182373 | A1* | 6/2018 | Almudafar-Depeyrot | G10L 13/00 |
| 2018/0218727 | A1* | 8/2018 | Cutler | H04M 7/006 |
| 2018/0342257 | A1* | 11/2018 | Huffman | G10L 21/013 |

* cited by examiner

DYNAMIC SPEECH OUTPUT CONFIGURATION

CROSS-REFERENCE TO RELATED APPLICATION

The present disclosure is related to, and claims benefit of, U.S. Provisional Patent Application Ser. No. 62/662,962, titled "Dynamic Speech Output Configuration," which was filed on Apr. 26, 2018 and the entire contents of which are incorporated by reference into the present disclosure.

BACKGROUND

Devices such as internet-of-things (IoT) devices, smart appliances, portable computing devices, and other types of devices may provide speech input and/or speech output capabilities that enable a user to provide input through voice commands and/or receive output as machine-generated speech. Traditionally, devices present speech output using a machine-generated "voice" that, though comprehensible, poorly approximates human speech patterns. Some devices, such as in-car navigation systems, provide speech output using pre-recorded segments of speech from celebrities or other persons. However, such traditional systems that use pre-recorded audio segments are not able to accommodate situations in which the text to be output as speech is not predetermined.

SUMMARY

Implementations of the present disclosure are generally directed to performing text-to-speech output using a voice profile that approximates the voice of the user that composed the text to be output. More specifically, implementations are directed to dynamically determining a machine learning developed voice profile to be employed to present speech output for received text, and employing the voice profile to generate the speech output through a text-to-speech engine that is configured to provide output in different voices depending on the determined voice profile to be used. Implementations are further directed to dynamically modifying the speech output generation of a virtual agent based on feedback data that describes a response of a user to the speech output.

In general, innovative aspects of the subject matter described in this specification can be embodied in methods that include operations of: receiving a message that includes text data from a sending user and, in response, dynamically determining a voice profile to be used by a text-to-speech (TTS) engine to present the text data as speech output, the voice profile including one or more attributes of a voice of the sending user; accessing the voice profile from data storage, the voice profile having been developed, using a machine learning algorithm, based on speech input from the sending user; and presenting at least a portion of the text data as speech output that is generated by the TTS engine employing the one or more attributes of the voice profile to approximate, in the speech output, the voice of the sending user.

Implementations can optionally include one or more of the following features: the message includes a profile identifier (ID) corresponding to the voice profile to be used to present the text data as the speech output; accessing the voice profile includes using the profile ID to retrieve the voice profile from data storage; the message indicates a user identifier (ID) of the sending user; accessing the voice profile includes using the user ID to retrieve the voice profile from data storage; the user ID includes one or more of an email address, a telephone number, a social network profile name, and a gamer tag; the one or more attributes of the voice profile include one or more of a tone, a pitch, a register, a speed, and a timbre of the voice of the sending user; the operations further include developing the voice profile, using the machine learning algorithm, based on a plurality of iterations of the speech input from the sending user; during each iteration the voice profile is used by the TTS engine to generate test speech output and the voice profile is further developed based on a comparison of the test speech output to the speech input; and/or the speech output is presented by a virtual assistant (VA).

Other implementations of any of the above aspects include corresponding systems, apparatus, and computer programs that are configured to perform the actions of the methods, encoded on computer storage devices. The present disclosure also provides a computer-readable storage medium coupled to one or more processors and having instructions stored thereon which, when executed by the one or more processors, cause the one or more processors to perform operations in accordance with implementations of the methods provided herein. The present disclosure further provides a system for implementing the methods provided herein. The system includes one or more processors, and a computer-readable storage medium coupled to the one or more processors having instructions stored thereon which, when executed by the one or more processors, cause the one or more processors to perform operations in accordance with implementations of the methods provided herein.

Implementations of the present disclosure provide one or more of the following technical advantages and improvements over traditional systems. By providing a system in which text data of messages is read in a machine-generated voice that approximates the voice of the sender, implementations provide a messaging experience that is more personal, individualized, and dynamically adapted to different senders compared to traditional systems that provide speech output using a single, generic, machine-generated voice. Through use of personalized speech output, implementations provide a message access experience that is less prone to confusion or user error compared to traditional systems, given that implementations enable a user to readily distinguish between messages sent by different users. Accordingly, implementations can avoid the expenditure of processing power, active memory, storage space, network bandwidth, and/or other computing resources that previously available, traditional systems expend to recover from user errors in erroneously addressed responses and mistakenly accessed messages. Implementations also provide advantages and improvements regarding improved user experience and improved safety. For example based on the customized voice output, a user can know who a message is from based on their voice, instead of needing to look at his or her device while driving. Also, implementations provide an improved user experience for visually impaired individuals, given that the system does not need to recite a "Message sender says" preamble prior to reading the message, as can be performed by traditional systems. Accordingly, implementations also avoid the expenditure of computing resources that traditional systems expend to provide additional output (e.g., visual and/or audio) to identify a sender of a message.

It is appreciated that aspects and features in accordance with the present disclosure can include any combination of the aspects and features described herein. That is, aspects and features in accordance with the present disclosure are not limited to the combinations of aspects and features specifically described herein, but also include any combination of the aspects and features provided.

The details of one or more implementations of the present disclosure are set forth in the accompanying drawings and the description below. Other features and advantages of the present disclosure will be apparent from the description and drawings, and from the claims.

DETAILED DESCRIPTION

Implementations of the present disclosure are directed to systems, methods, devices, and media for providing dynamically configured speech output. In some implementations, text data from a message, such as an email, text message, instant message, and so forth, is presented as speech output through a text-to-speech (TTS) engine that employs a voice profile to provide the speech output in a machine-generated voice that approximates that of the sender of the message. Such implementations allow users of platforms that provide speech output, such as personal assistant devices, personal assistant applications executing on smartphones or other computing devices, in-vehicle automotive systems, and so forth, to receive speech output that is customized based on the sender's identity. The recipient of the messages can also elect to enable or disable the feature to customize output for incoming messages based on the sender of the messages. The sender of the messages can also indicate the type of voice they would prefer the TTS engine use to render their text to a recipient, such as a machine-generated voice that approximates the sender's voice, or as a default voice. In some implementations, the preferred voice profile to be used to present a sender's messages can be specified in a sender's user profile, as a preference or attribute of the sending user. In some implementations, the voice profile to be used can be indicated (e.g., as metadata) in the message itself. In general, a voice profile can specify attributes of the voice to be used to render output text as speech, such as the tone, pitch, register, timbre, pacing, gender, accent, and so forth. A voice profile can be generated through a machine learning (ML) process, in which a user reads one or more sample phrases which are collected and analyzed to develop the voice model of the user's speech.

In some implementations, the speech output of a virtual agent (VA), such as a personal assistant device or a bot in a customer service environment, is modified based on feedback received from a recipient of the speech output. For example, a user can interact with a VA through speech input, text input, command input, and so forth, and the speech output of the VA can be generated according to a voice profile that specifies attributes such as the pitch, tone, gender, and/or other attributes of the machine-generated voice. Feedback data can be collected from the user in the form of biometric data, the results of analysis of the recipient's speech and/or text inputs, explicit feedback from the recipient, and so forth, to attempt to gauge the user's reaction to the speech output of the VA. The feedback data can be analyzed, using a ML process, to refine the voice model to attempt to provide speech output that is more agreeable to the listening user.

Figure 1:
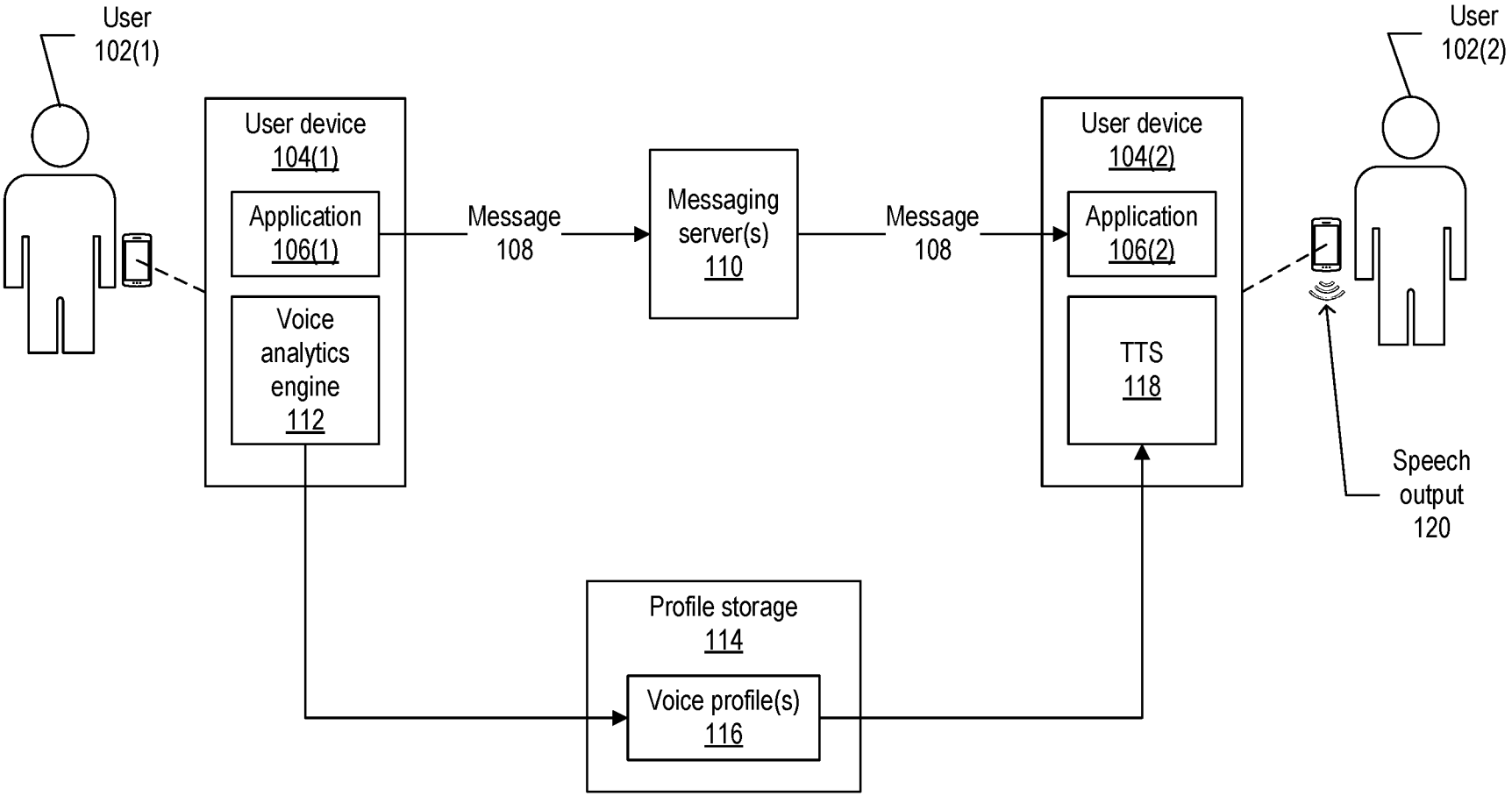
FIG. 1 depicts an example system for modifying speech output of text data from a message based on a voice profile of a sending user, according to implementations of the present disclosure.

FIG. 1 depicts an example system for modifying speech output of text data from a message based on a voice profile of a sending user, according to implementations of the present disclosure. As shown in the example of FIG. 1, a user 102(1) (e.g., a sending user) can employ a user device 104(1), and a user 102(2) (e.g., a receiving user) can employ a user device 104(2). The user devices 104(1) and 104(2) can include any suitable type of computing device, such as a portable computing device (e.g., smartphone, tablet computer, wearable computer, portable gaming platform, etc.) or a less portable type of computing device (e.g., desktop computer, laptop computer, gaming console, other home entertainment system, etc.).

The user device 104(1) can execute an application 106(1), and the user device 104(2) can execute an application 106(2). The applications 106(1) and 106(2) can be client applications for a messaging service. For example, the applications can be email clients for composing, sending, receiving, and viewing emails. As another example, the applications can be messaging clients for composing, sending, receiving, and viewing text messages such as Short Message Service (SMS) messages, Multimedia Messaging Service (MMS) messages, and so forth. As another example, the applications can be instant messaging (IM) clients for exchanging IMs between users, such as in an online gaming forum or other computing environment. As another example, the applications can be social media applications that allow users to exchange messages and/or otherwise interact over a social network. Implementations also support any other suitable type of applications that enable the exchange of messages that include text data.

The user 102(1) can employ the application 106(1) to compose and send a message 108 to the recipient user 102(2). The message 108 can include any suitable amount of text data, in the form of alphanumeric characters, symbols, and so forth. The message 108 can also include other types of information, such as images, video, audio, graphics, and so forth. The message 108 can be conveyed, over one or networks, from the application 106(1) to the application 106(2) via a messaging service provided by one or more messaging servers 110. The messaging server(s) 110 can include any suitable number and type of computing device(s). In some examples, the message 108 can be conveyed over one or more networks from the application 106(1) to the application 106(2) without using messaging server(s) 110 as an intermediary, such as through a peer-to-peer (P2P) messaging utility that employs a (e.g., wireless) network connection between the two user devices 104. The message 108 can be received by the application 106(2) and presented to the receiving user 102(2). In some instances, the message 108 includes a recipient identifier (ID) such as an email address, telephone number, social network login, gamer tag, IM handle, and so forth, and the message 108 is routed, using the recipient ID, to the appropriate application 106(2) to which the user 102(2) has been authenticated.

In some implementations, the user device 104(2) includes a TTS engine 118 that receives text data as input and provides speech output 120 that reads at least a portion of the text data in a machine-generated voice provided by the TTS engine 118. The application 106(2) can interact with, and/or include, the TTS engine 118 to present the text data of received messages 108 as speech output 120. In some implementations, the TTS 118 employs a particular voice profile 116 to render the text data as speech output 120. A voice profile 116 can specify one or more attributes of the machine-generated voice to be used to render the speech output 120. Such attributes can include, but are not limited to, the pitch, timbre, register, tone, gender, accent, speed, pace, and/or other attributes of the machine-generated voice.

In some implementations, one or more voice profiles 116 can be stored in profile storage 114. The profile storage 114 can provide any suitable type of data storage, of any suitable size. Although the example depicts the profile storage 114 as a separate storage device, in some implementations the profile storage 114 can be included in one or more of the user device 104(1), the user device 104(2), the messaging server(s) 110, and/or other computing device(s).

In some implementations, a particular voice profile 116 can be selected for use in presenting the text data of a message 108 as speech output 120, and the particular voice profile 116 can be selected based on the identity of the sending user 102(1) of the message 108. For example, a voice profile 116 can be selected to provide speech output 120 that approximates (e.g., sounds like) the speaking voice of the sending user 102(1). In some implementations, the message 108 includes (e.g., as metadata) a profile ID of a voice profile 116 to be used by the TTS engine 118 to read the message 108. In such instances, the sending user 102(1) can use the application 106(1) to specify the profile ID, to request that the message 108 is read using the voice profile 116 corresponding to the specified profile ID. The TTS engine 118 and/or the application 106(2) can retrieve, from the profile storage 114, the particular voice profile 116 that corresponds to the profile ID included in the message 108. In some implementations, the voice profile(s) 116 can be stored according to an associated sender ID, such as the sending user's email address, telephone number, social media login, gamer tag, and so forth. In such instances, the TTS engine 118 and/or the application 106(2) can retrieve, from the profile storage 114, the particular voice profile 116 that corresponds to the sender ID of the message 108. The retrieved voice profile 116 can be used to read the text data of the message 108 as the speech output 120. Accordingly, the voice profile(s) 116 can be stored in the profile storage 114 with a key value that uniquely identifies each voice profile 116, such as the profile ID and/or the sender ID described above. In some implementations, the message 108 includes metadata that includes the voice profile 116 itself, such that the metadata describes the attributes of the voice profile to be used to render the text data of the message 108 as speech output.

In some implementations, the voice profile 116 of a user 102 can be trained or otherwise developed using a suitable ML algorithm applied by a voice analytics engine 112 executing on the user device 104(1) or elsewhere. For example, the user 102(1) can be asked to read a sample training text one or more times, and the user's voice can be recorded. The recorded speech of the user 102(1) can be used to develop the voice profile 116 of the user 102(1), such that speech output 120 rendered using the voice profile 116 approximates the speaking voice of the user 102(1). In some implementations, the training of the voice profile 116 can include multiple iterations. In each iteration, the user 102(1) can recite the sample training speech, which is used to develop a version of the voice profile 116, and the voice profile 116 can then be used to read back the sample training speech. The user's recited speech can be compared to the machine-generated output speech. If the comparison is sufficiently similar (e.g., within a threshold statistical similarity or above a threshold confidence metric), the voice profile 116 can be deemed sufficiently developed. If the comparison is not sufficiently similar, another iteration can be performed in which the user again recites the same (or different) sample training speech, which is then used to further develop the voice profile 116. In some implementations, the user 102(1) may be asked to indicate whether the machine-generated speech for each iteration is close enough (e.g., whether the user is satisfied that the output sounds like them), and the user's response can be used to determine whether another iteration of the training is to be performed. In some implementations, the voice profile 116 of a user 102 can be refined, retrained, or otherwise altered over time to account for changes in the user's voice due to aging or other changes experienced by the user.

In some implementations, the sending user 102 can specify (e.g., as an option in the composed message 108) whether the message 108 is to be output using a particular voice profile 116, and the particular voice profile 116 to be used to read the message 108 to the recipient user 102(2). For example, the message composition dialog of the application 106 can include an option to let the user 102(1) specify (e.g., toggle on or off) the speech output option for the message, and select a particular voice profile 116 to be used. The profile ID of the selected voice profile 116 can be included as metadata in the transmitted message 108. In some implementations, if the sending user 102(1) does not specify a particular voice profile 116 to be used, the application 106(2) and/or the TTS 118 can select a default voice profile 116 to be used. In some examples, the default voice profile 116 can be the stored voice profile 116 that corresponds to the sender ID of the user 102(1), such as the sending user's email address, telephone number, and so forth. In some examples, the default is a voice profile that is a typical machine-generated voice (e.g., not sounding like the sending user or other particular individual).

The implementations provide a mechanism by which the messages 108 of a sending user are read in a machine-generated voice that approximates that of the sending user, to provide a more personal and individual messaging experience that approximates a live, in-person interaction between users, at least with respect to spoken text. The determination of the voice profile 116 to be used to read each message 108 received at the application 106(2) can be dynamically performed on receiving each message 108, based on the sender of the particular message 108. A dynamic operation (also described as a real time operation) is an operation that is automatically performed without requiring human input and without any intentional delay with respect to a triggering event, taking into account the processing limitations of the computing system(s) performing the operations and the time needed to perform the operations. For example, the determination of the voice profile 116 to be used to read a message 108 can be performed dynamically with respect to the message 108 be received by the application 106(2) and/or with respect to the message 108 being opened for reading in the application by the user 102(2). Accordingly, messages 108 from different senders may be read using different voice profiles 116, such as profiles that each approximates the particular voice of the respective sender. Use of different, sender-specific voice profiles provides a richer and more varied user experience compared to traditional speech output systems that use the same generic, machine-generated voice to render all speech from a device.

Figure 2:
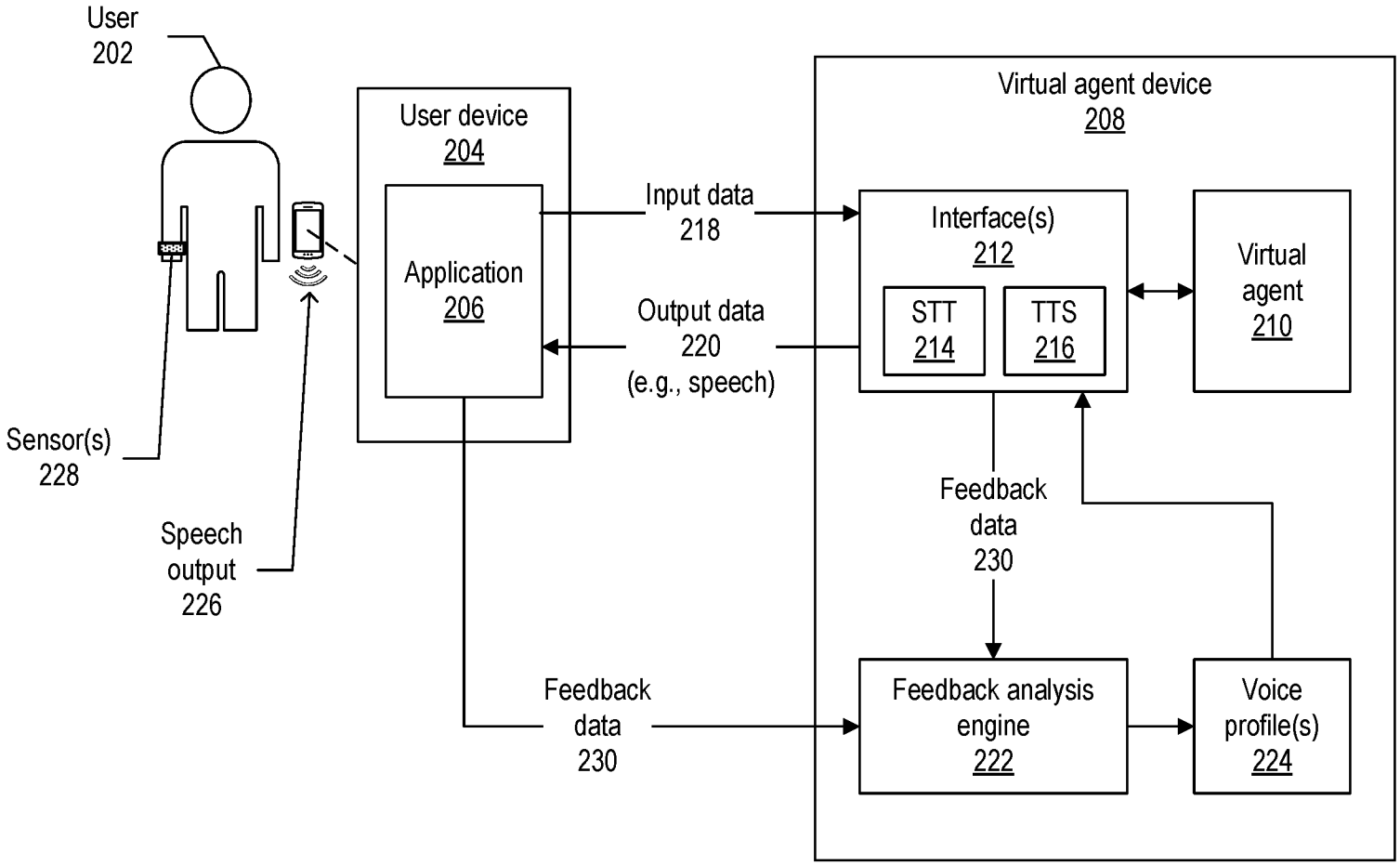
FIG. 2 depicts an example system for modifying speech output from a virtual agent, based on feedback data from a user, according to implementations of the present disclosure.

FIG. 2 depicts an example system for modifying speech output from a VA, based on feedback data from a user, according to implementations of the present disclosure. As shown in the example of FIG. 2, a user 202 can operate a user device 204 that executes an application 206. The user device 204 can be any suitable type of computing device, including portable computing device(s) or less portable types of computing device(s) as described above.

The user 202 can use their user device 204 to interact with a VA device 208 that executes a VA 210. The VA device 208 can include one or more interfaces 212. In some instances, the interface(s) 212 can include a TTS engine 216 and/or a speech-to-text (STT) engine 214, which respectively render text input as speech output or speech input as text output. The application 206 executing on the user device 204 can interact with the interface(s) 212, enabling the user 202 to carry on a conversation with the VA 210 through input and/or output that is speech-based and/or text-based. For example, the user 202 can employ the application 206 to specify input data 218 (e.g., as a question) to the VA, in the form of text input, speech input, or otherwise. The interface(s) 212 can provide the input data 218 to the VA 210, in some instances after the STT 214 transcribes the speech input of the user into text. The VA 210 can analyze the input data 218 and develop output data 220 that is a response to the input data 210, as appropriate. In some examples, the VA 210 can interact with various other services and/or systems (not shown) to collect information used to formulate the output data 220. The output data 220 can be provided by the VA 210 to the interface(s) 212, which communicate the output data 220 to the application 206 for presentation to the user 202. A conversation between the user 202 and the VA 210 can include any appropriate number of such interactions.

In some implementations, the TTS 216 of the interface(s) 212 can be used to render the output data 220 as speech output 226. The TTS 216 can use a voice profile 224 to render the speech output 226 in a particular machine-generated voice, as described above. In some implementations, the output data 220 is communicated to the application 206 as audio data that can be output as speech through one or more speakers of the user device 204. In some implementations, the output data 220 is communicated to the application 206, which uses a locally executing TTS to generate the speech output 226 from the output (e.g., text) data 220, using a particular voice profile 224. Accordingly, the text-to-speech operation(s) can be performed on either or both of the VA device 208 and the user device 204.

In some implementations, feedback data 230 can be collected from the user 202 during or after the presentation of the output data 220 to the user 202, and the feedback data 230 can be employed by a feedback analysis engine 222 to refine or otherwise alter the voice profile 224 that is being used to generate the speech output 226 for the user 202. For example, the feedback data 230 can include biometric data that describes one or more physiological characteristics of the user 202, collected during and/or following the presentation of the output data 220 (e.g., as speech output) to the user 202. Such biometric data can include, but is not limited to, the user's heart rate, pulse, perspiration, respiration rate, eye movements, facial movements, facial expressions (e.g., frowns, smiles, etc.), other body movements (e.g., fidgeting), neural activity measurements (e.g., brain wave measurements), and so forth. The feedback data 230 can also include image(s) and/or video of the user 202, collected during their interaction with the VA and analyzed to determine the emotional state of the user. The feedback data 230 can be collected through sensor(s) 228 (also described as sensor device(s)) that are worn by or otherwise in proximity to the user 202, such as sensors to measure biometric data, collect image(s) and/or video of the user 202, and so forth.

In some implementations, the feedback data 230 can include results of an analysis of the additional input data 218 that is provided by the user 202 during or following the presentation of the output data 220. For example, the text data input by the user in response to presentation of the output data can be analyzed, using natural language processing (NLP) or other techniques, to infer a mood and/or emotional state of the user 202. As another example, the speech data input by the user in response to the presentation of the output data can be analyzed, using suitable speech analysis techniques, to determine the mood and/or emotional state of the user 202. Feedback data 230 can also include explicit feedback provided by the user 202 through the application 206 or otherwise, such as the user 202 explicitly indicating that they like or dislike the particular voice profile being used by the VA for speech output.

The feedback analysis engine 222 can use the feedback data 230 to alter the voice profile 224 being used to provide speech output to the user 202. For example, if the feedback data 230 indicates that the user 202 is angry or agitated, the voice profile 224 can be modified to provide a more soothing or calming voice for the speech output. As another example, the voice profile 224 can be modified to substantially mirror the mood of the user 202 as determined based on the feedback data 230, such that a cheerful user is spoken to in a cheerful voice, or a somber user is spoken to in a somber voice, and so forth. The feedback analysis engine 222 can use any suitable ML algorithms to adapt the voice profile 224, with the goal of providing a more positive and/or appropriate speech output experience for the user 202. Accordingly, the voice profile 224 that is used for the user 202 can be dynamically adapted during the interaction between the user and the VA, to attempt to provide a more suitable voice and improved user experience for the user in various circumstances.

In some implementations, the voice profile 224 can be modified over time during an interaction between the user and the VA. For example, when the user first begins interacting with the VA, a default voice profile can be selected to begin the conversation. The default voice profile can be an overall default, or can be a default that has been previously determined as suitable for users that share particular characteristics with the particular user 202. For example, the default voice profile can be selected based on the user's age range, gender, geographic location, and/or other characteristics. In some instances, the default voice profile 224 may be a particular voice profile that was developed during a previous interaction with the same user, and/or which was previously determined as suitable for interacting with the particular user to provide a positive user experience based on previously collected feedback data.

Throughout the course of the interaction between the user and the VA, as the user receives output from the VA and responds to the output with additional input, movements, and/or physiological changes, the feedback analysis engine 222 can collect feedback data 230 from the user, analyze the feedback data 230 to determine a mood (or change in mood) of the user, and modify the voice profile based on the analysis. Accordingly, the voice profile can be described as a set of personality attributes that alter the artificial "personality" of the speech output to the user. The modification of the voice profile for the user can be performed dynamically, in real time during the interaction between the user and the VA, in response to the dynamic collection of feedback data from the user, such that the adaptations to the voice profile are applied during a current session of the user interacting with the VA. The adjustment of the voice profile can also be performed after-the-fact, following a conclusion of the interaction between the user and the VA, such that the adaptations to the voice profile are applied during a subsequent session with the user.

In some implementations, the adaptations of the voice profile can be performed such that the voice profile is altered to illicit a more positive response from the user, and/or to cause the user to enter a more positive emotional state (e.g., happy, content, satisfied or calm, instead of sad, angry, agitated, or frustrated, etc.). The updates to the voice profile can be through trial-and-error initially. An update can be made and the user's response can be gauged through the feedback data. If the update causes a positive change in the user's demeanor, a further update can be made in the same direction for one or more attributes. For example, a slight change in pitch, timbre, and/or tone that causes a positive change to the user's demeanor can be followed with a somewhat greater change (in the same direction) in the pitch, timbre, and/or tone, such that positive changes are reinforced until a negative change demeanor is detected. In this way, the detected feedback data from the user can be used as a gauge to determine when each of the attributes of the voice profile have been adjusted to an optimal value.

The updates to the voice profile can also be based on other factors, such as the characteristics of the user, time of day, location of the user, the topic of conversation between the user and the VA, and so forth. In some implementations, the adjustments to the speech output can include adjustments to the grammar, vocabulary, and/or other content of what is being said, instead of or in addition to altering the manner in which the speech output is being read. Accordingly, adjustments can be made to accommodate regional or other differences in language, vocabulary, jargon, accent, formality versus informality, degree of directness or subtlety, humor versus seriousness, and so forth. Such adjustments to the speech output can be realized through adjustments to an ML-trained model, in which feedback from users is analyzed and used to adjust not only the attributes of the voice and/or the attributes of the content and/or words included in the message In some implementations, the VA 210, interface(s) 212, feedback analysis engine 222, and/or voice profile(s) 224 execute on the user device 204 instead of on a separate device, such as in examples where the user 202 is interacting with a VA that is an assistant application executing on the user device 204. In some examples, the VA may be provided as a component of a (e.g. home) personal assistant device that is used to make requests to remote services and/or to control local smart appliances or other internet-of-things (IoT) devices in the home or other environment. In some examples, the VA is provided as a virtual customer service representative in a call center or other service environment, such that the user is interacting with the VA to receive help regarding products or services, via speech and/or text interaction.

Figure 3:
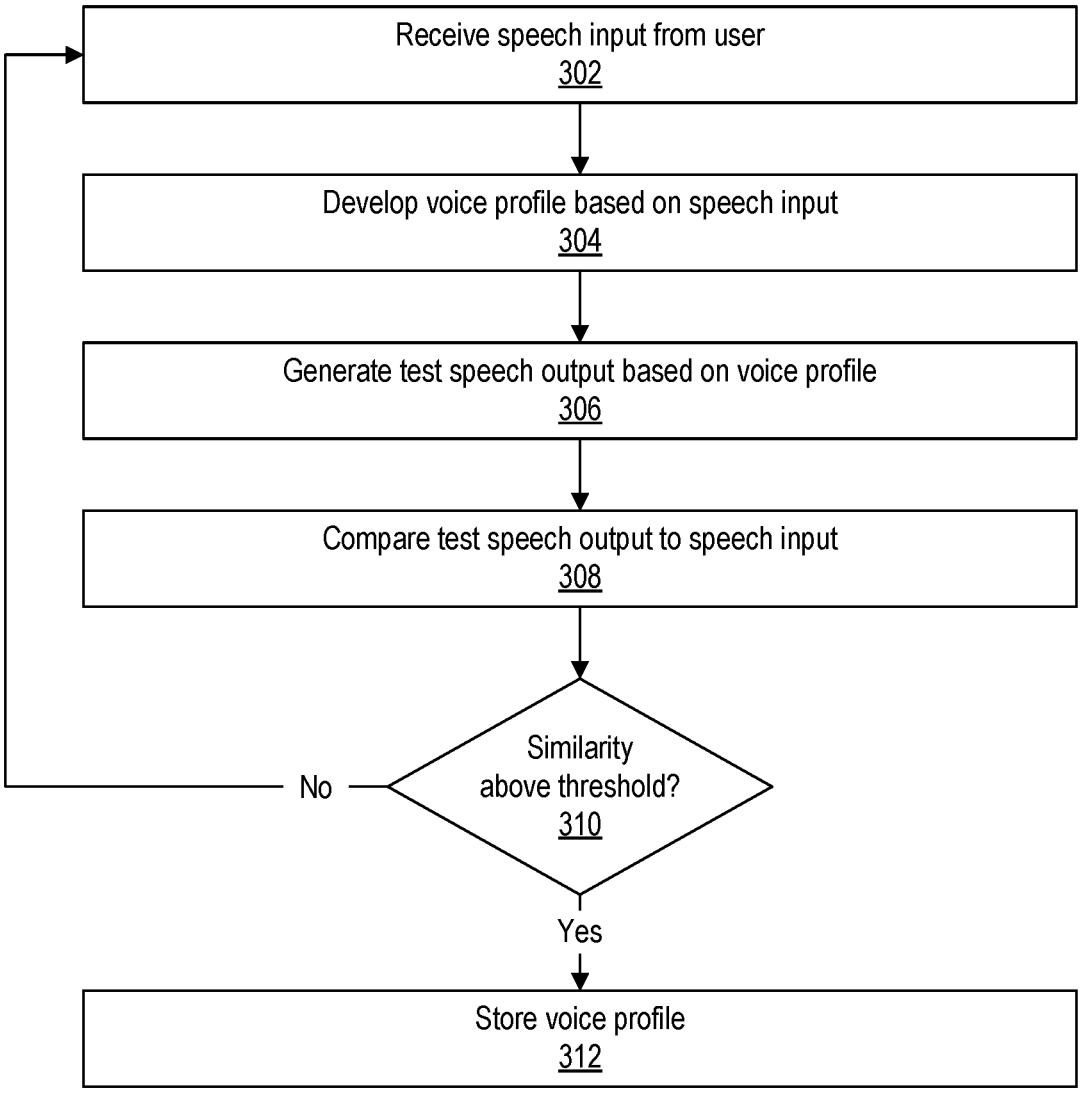
FIG. 3 depicts a flow diagram of an example process for developing a voice profile for speech output, according to implementations of the present disclosure.

FIG. 3 depicts a flow diagram of an example process for developing (e.g., training) a voice profile for speech output, according to implementations of the present disclosure. Operations of the process can be performed by one or more of the application 106(1), the application 106(2), the voice analytics engine 112, the TTS 118, and/or other software module(s) executing on the user device 104(1), the user device 104(2), the messaging server(s) 110, the profile storage 114, and/or elsewhere.

Speech input is received (302) from the user. For example, the speech input may be sample training speech that is read by the user, prompted by a request from the application, for developing or refining the voice profile to approximate the user's voice. Based on the speech input, the voice profile is developed (304). Test speech output is generated (306) based on the voice profile, and the test speech output is compared to the speech input provided by the user (308) to determine how close the output is to the input. Such comparison may be a statistical comparison of the audio input to the audio output. In some instances, the user themselves (or another individual) may listen to the input and/or output and manually gauge the difference between the two. If the comparison indicates a similarity that is sufficiently close (e.g., above a similarity threshold) (310), the voice profile is stored in profile storage 114, to be available for use in generate speech output for received messages 108 and/or other purposes. If the output is not sufficiently similar to the input, another iteration may be performed and additional speech input may be collected (302) from the user. The process may proceed through an appropriate number of iterations until the speech output sufficiently approximates the speaking voice of the user.

Figure 4:
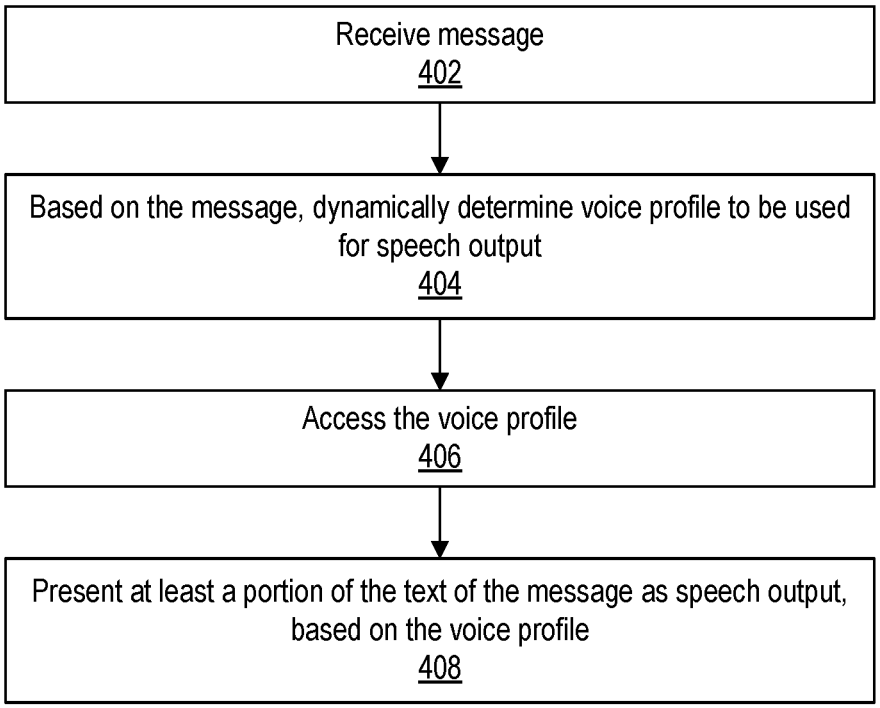
FIG. 4 depicts a flow diagram of an example process for modifying speech output of text data from a message based on a voice profile of a sending user, according to implementations of the present disclosure.

FIG. 4 depicts a flow diagram of an example process for modifying speech output of text data from a message based on a voice profile of a sending user, according to implementations of the present disclosure. Operations of the process can be performed by one or more of the application 106(1), the application 106(2), the voice analytics engine 112, the TTS 118, and/or other software module(s) executing on the user device 104(1), the user device 104(2), the messaging server(s) 110, the profile storage 114, and/or elsewhere.

As described above with reference to FIG. 1, a message 108 is received (402). Based on the message 108 (e.g., based on the sender of the message), a voice profile is dynamically determined (404) for use in speech output. The voice profile is accessed (406) from the profile storage 114, and at least a portion of the text data of the received message is presented (408) as speech output based on the determined voice profile. As described above, the selected voice profile may correspond to the sender of the message, such that the message is read in a voice that approximates that of the sender.

Figure 5:
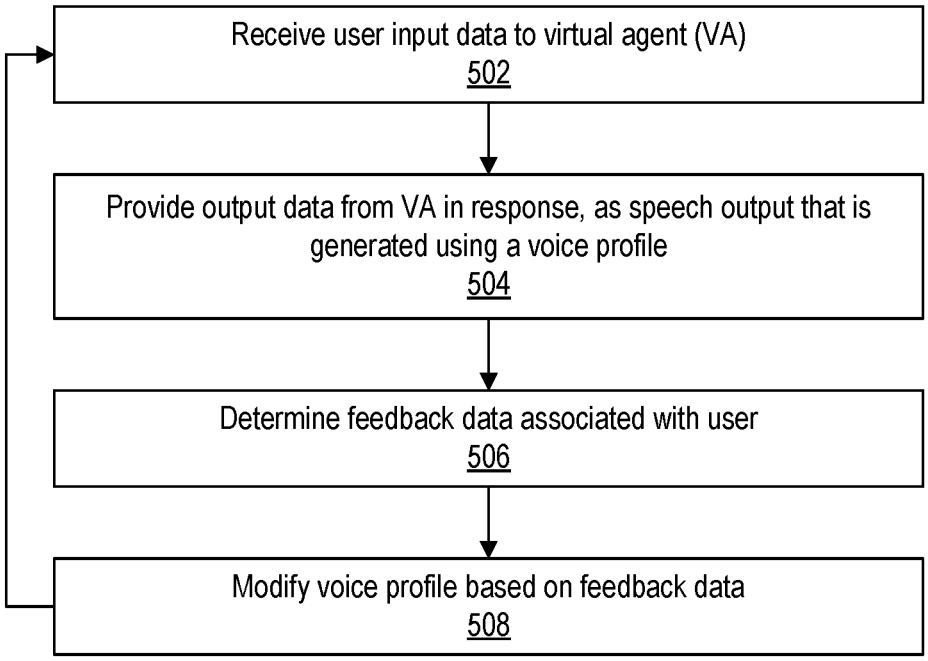
FIG. 5 depicts a flow diagram of an example process for modifying speech output from a virtual agent, based on feedback data from a user, according to implementations of the present disclosure.

FIG. 5 depicts a flow diagram of an example process for modifying speech output from a virtual agent, based on feedback data from a user, according to implementations of the present disclosure. Operations of the process can be performed by one or more of the application 206, the interface 212, the STT 214, the TTS 216, the VA device 108, the feedback analysis engine 222, and/or other software module(s) executing on the user device 104, the VA device 108, and/or elsewhere.

As described above with reference to FIG. 2, a user's input data to a VA is received (502) and analyzed to generate output data in response. The output data is provided from the VA (504) as speech output that is generated using a voice profile. During and/or immediately following the presentation of the speech output, feedback data associated with the user is determined (506). The voice profile is modified (508) based on the feedback data. The process may continue such that the speech output to the user is adapted (e.g., continuously) throughout the interactions between the user and the VA, to attempt to provide an optimal speech output to the user and a positive user experience.

Figure 6:
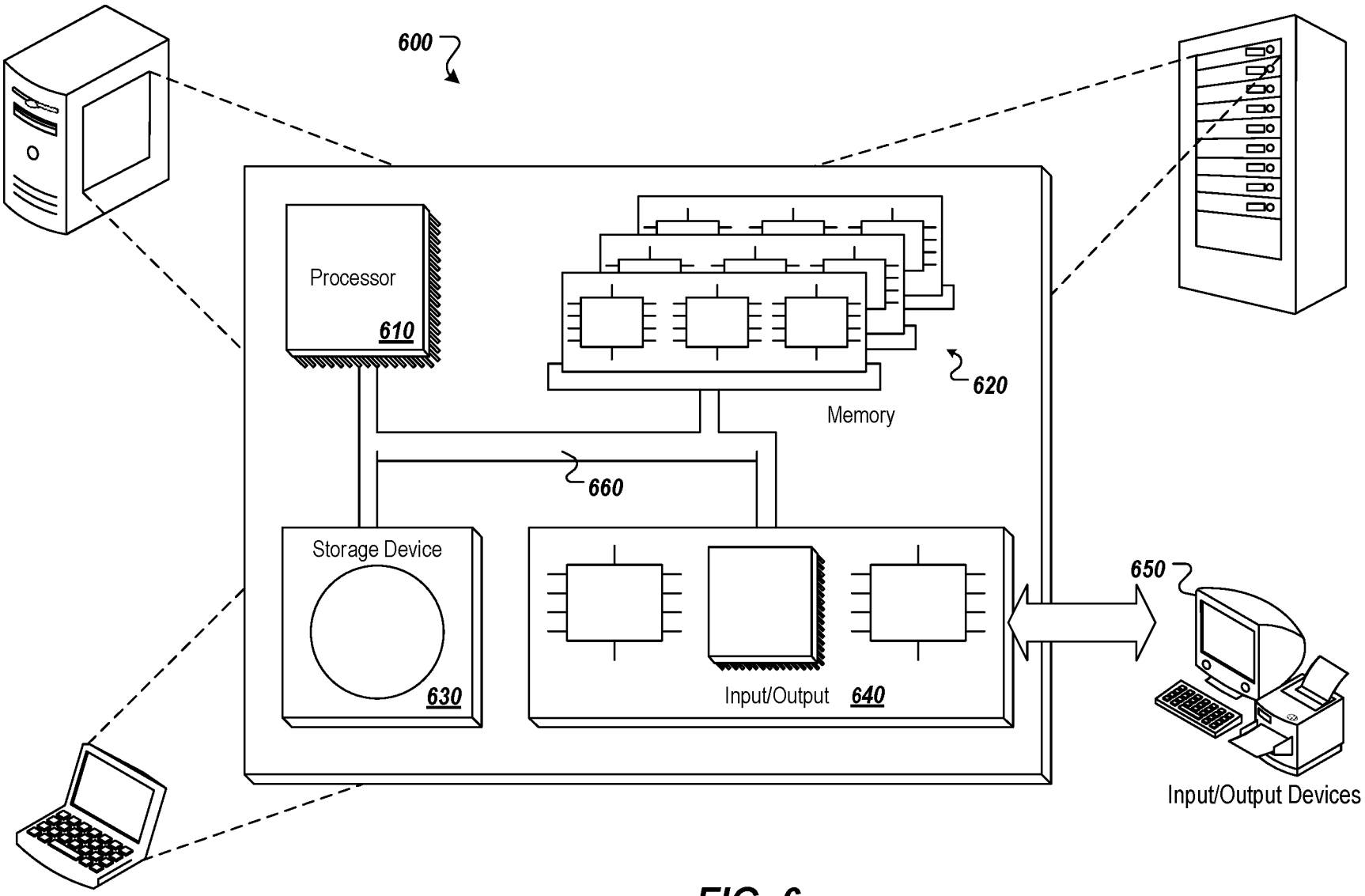
FIG. 6 depicts an example computing system, according to implementations of the present disclosure.

FIG. 6 depicts an example computing system, according to implementations of the present disclosure. The system 600 may be used for any of the operations described with respect to the various implementations discussed herein. For example, the system 600 may be included, at least in part, in one or more of the user device(s) 104(1), and 104(2), the messaging server(s) 110, the profile storage 114, the user device 104, the VA device 208, and/or other computing device(s) or system(s) described herein. The system 600 may include one or more processors 610, a memory 620, one or more storage devices 630, and one or more input/output (I/O) devices 650 controllable through one or more I/O interfaces 640. The various components 610, 620, 630, 640, or 650 may be interconnected through at least one system bus 660, which may enable the transfer of data between the various modules and components of the system 600.

The processor(s) 610 may be configured to process instructions for execution within the system 600. The processor(s) 610 may include single-threaded processor(s), multi-threaded processor(s), or both. The processor(s) 610 may be configured to process instructions stored in the memory 620 or on the storage device(s) 630. The processor(s) 610 may include hardware-based processor(s) each including one or more cores. The processor(s) 610 may include general purpose processor(s), special purpose processor(s), or both.

The memory 620 may store information within the system 600. In some implementations, the memory 620 includes one or more computer-readable media. The memory 620 may include any number of volatile memory units, any number of non-volatile memory units, or both volatile and non-volatile memory units. The memory 620 may include read-only memory, random access memory, or both. In some examples, the memory 620 may be employed as active or physical memory by one or more executing software modules.

The storage device(s) 630 may be configured to provide (e.g., persistent) mass storage for the system 600. In some implementations, the storage device(s) 630 may include one or more computer-readable media. For example, the storage device(s) 630 may include a floppy disk device, a hard disk device, an optical disk device, or a tape device. The storage device(s) 630 may include read-only memory, random access memory, or both. The storage device(s) 630 may include one or more of an internal hard drive, an external hard drive, or a removable drive.

One or both of the memory 620 or the storage device(s) 630 may include one or more computer-readable storage media (CRSM). The CRSM may include one or more of an electronic storage medium, a magnetic storage medium, an optical storage medium, a magneto-optical storage medium, a quantum storage medium, a mechanical computer storage medium, and so forth. The CRSM may provide storage of computer-readable instructions describing data structures, processes, applications, programs, other modules, or other data for the operation of the system 600. In some implementations, the CRSM may include a data store that provides storage of computer-readable instructions or other information in a non-transitory format. The CRSM may be incorporated into the system 600 or may be external with respect to the system 600. The CRSM may include read-only memory, random access memory, or both. One or more CRSM suitable for tangibly embodying computer program instructions and data may include any type of non-volatile memory, including but not limited to: semiconductor memory devices, such as EPROM, EEPROM, and flash memory devices; magnetic disks such as internal hard disks and removable disks; magneto-optical disks; and CD-ROM and DVD-ROM disks. In some examples, the processor(s) 610 and the memory 620 may be supplemented by, or incorporated into, one or more application-specific integrated circuits (ASICs).

The system 600 may include one or more I/O devices 650. The I/O device(s) 650 may include one or more input devices such as a keyboard, a mouse, a pen, a game controller, a touch input device, an audio input device (e.g., a microphone), a gestural input device, a haptic input device, an image or video capture device (e.g., a camera), or other devices. In some examples, the I/O device(s) 650 may also include one or more output devices such as a display, LED(s), an audio output device (e.g., a speaker), a printer, a haptic output device, and so forth. The I/O device(s) 650 may be physically incorporated in one or more computing devices of the system 600, or may be external with respect to one or more computing devices of the system 600.

The system 600 may include one or more I/O interfaces 640 to enable components or modules of the system 600 to control, interface with, or otherwise communicate with the I/O device(s) 650. The I/O interface(s) 640 may enable information to be transferred in or out of the system 600, or between components of the system 600, through serial communication, parallel communication, or other types of communication. For example, the I/O interface(s) 640 may comply with a version of the RS-232 standard for serial ports, or with a version of the IEEE 1284 standard for parallel ports. As another example, the I/O interface(s) 640 may be configured to provide a connection over Universal Serial Bus (USB) or Ethernet. In some examples, the I/O interface(s) 640 may be configured to provide a serial connection that is compliant with a version of the IEEE 1394 standard.

The I/O interface(s) 640 may also include one or more network interfaces that enable communications between computing devices in the system 600, or between the system 600 and other network-connected computing systems. The network interface(s) may include one or more network interface controllers (NICs) or other types of transceiver devices configured to send and receive communications over one or more networks using any network protocol.

Computing devices of the system 600 may communicate with one another, or with other computing devices, using one or more networks. Such networks may include public networks such as the internet, private networks such as an institutional or personal intranet, or any combination of private and public networks. The networks may include any type of wired or wireless network, including but not limited to local area networks (LANs), wide area networks (WANs), wireless WANs (WWANs), wireless LANs (WLANs), mobile communications networks (e.g., 3G, 4G, Edge, etc.), and so forth. In some implementations, the communications between computing devices may be encrypted or otherwise secured. For example, communications may employ one or more public or private cryptographic keys, ciphers, digital certificates, or other credentials supported by a security protocol, such as any version of the Secure Sockets Layer (SSL) or the Transport Layer Security (TLS) protocol.

The system 600 may include any number of computing devices of any type. The computing device(s) may include, but are not limited to: a personal computer, a smartphone, a tablet computer, a wearable computer, an implanted computer, a mobile gaming device, an electronic book reader, an automotive computer, a desktop computer, a laptop computer, a notebook computer, a game console, a home entertainment device, a network computer, a server computer, a mainframe computer, a distributed computing device (e.g., a cloud computing device), a microcomputer, a system on a chip (SoC), a system in a package (SiP), and so forth. Although examples herein may describe computing device(s) as physical device(s), implementations are not so limited. In some examples, a computing device may include one or more of a virtual computing environment, a hypervisor, an emulation, or a virtual machine executing on one or more physical computing devices. In some examples, two or more computing devices may include a cluster, cloud, farm, or other grouping of multiple devices that coordinate operations to provide load balancing, failover support, parallel processing capabilities, shared storage resources, shared networking capabilities, or other aspects.

Implementations and all of the functional operations described in this specification may be realized in digital electronic circuitry, or in computer software, firmware, or hardware, including the structures disclosed in this specification and their structural equivalents, or in combinations of one or more of them. Implementations may be realized as one or more computer program products, i.e., one or more modules of computer program instructions encoded on a computer readable medium for execution by, or to control the operation of, data processing apparatus. The computer readable medium may be a machine-readable storage device, a machine-readable storage substrate, a memory device, a composition of matter effecting a machine-readable propagated signal, or a combination of one or more of them. The term "computing system" encompasses all apparatus, devices, and machines for processing data, including by way of example a programmable processor, a computer, or multiple processors or computers. The apparatus may include, in addition to hardware, code that creates an execution environment for the computer program in question, e.g., code that constitutes processor firmware, a protocol stack, a database management system, an operating system, or a combination of one or more of them. A propagated signal is an artificially generated signal, e.g., a machine-generated electrical, optical, or electromagnetic signal that is generated to encode information for transmission to suitable receiver apparatus.

A computer program (also known as a program, software, software application, script, or code) may be written in any appropriate form of programming language, including compiled or interpreted languages, and it may be deployed in any appropriate form, including as a standalone program or as a module, component, subroutine, or other unit suitable for use in a computing environment. A computer program does not necessarily correspond to a file in a file system. A program may be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program may be deployed to be executed on one computer or on multiple computers that are located at one site or distributed across multiple sites and interconnected by a communication network.

The processes and logic flows described in this specification may be performed by one or more programmable processors executing one or more computer programs to perform functions by operating on input data and generating output. The processes and logic flows may also be performed by, and apparatus may also be implemented as, special purpose logic circuitry, e.g., an FPGA (field programmable gate array) or an ASIC (application specific integrated circuit).

Processors suitable for the execution of a computer program include, by way of example, both general and special purpose microprocessors, and any one or more processors of any appropriate kind of digital computer. Generally, a processor may receive instructions and data from a read only memory or a random access memory or both. Elements of a computer can include a processor for performing instructions and one or more memory devices for storing instructions and data. Generally, a computer may also include, or be operatively coupled to receive data from or transfer data to, or both, one or more mass storage devices for storing data, e.g., magnetic, magneto optical disks, or optical disks. However, a computer need not have such devices. Moreover, a computer may be embedded in another device, e.g., a mobile telephone, a personal digital assistant (PDA), a mobile audio player, a Global Positioning System (GPS) receiver, to name just a few. Computer readable media suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto optical disks; and CD ROM and DVD-ROM disks. The processor and the memory may be supplemented by, or incorporated in, special purpose logic circuitry.

To provide for interaction with a user, implementations may be realized on a computer having a display device, e.g., a CRT (cathode ray tube) or LCD (liquid crystal display) monitor, for displaying information to the user and a keyboard and a pointing device, e.g., a mouse or a trackball, by which the user may provide input to the computer. Other kinds of devices may be used to provide for interaction with a user as well; for example, feedback provided to the user may be any appropriate form of sensory feedback, e.g., visual feedback, auditory feedback, or tactile feedback; and input from the user may be received in any appropriate form, including acoustic, speech, or tactile input.

Implementations may be realized in a computing system that includes a back end component, e.g., as a data server, or that includes a middleware component, e.g., an application server, or that includes a front end component, e.g., a client computer having a graphical UI or a web browser through which a user may interact with an implementation, or any appropriate combination of one or more such back end, middleware, or front end components. The components of the system may be interconnected by any appropriate form or medium of digital data communication, e.g., a communication network. Examples of communication networks include a local area network ("LAN") and a wide area network ("WAN"), e.g., the Internet.

The computing system may include clients and servers. A client and server are generally remote from each other and typically interact through a communication network. The relationship of client and server arises by virtue of computer programs running on the respective computers and having a client-server relationship to each other.

While this specification contains many specifics, these should not be construed as limitations on the scope of the disclosure or of what may be claimed, but rather as descriptions of features specific to particular implementations. Certain features that are described in this specification in the context of separate implementations may also be implemented in combination in a single implementation. Conversely, various features that are described in the context of a single implementation may also be implemented in multiple implementations separately or in any suitable sub-combination. Moreover, although features may be described above as acting in certain combinations and even initially claimed as such, one or more features from a claimed combination may in some examples be excised from the combination, and the claimed combination may be directed to a sub-combination or variation of a sub-combination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems may generally be integrated together in a single software product or packaged into multiple software products.

A number of implementations have been described. Nevertheless, it will be understood that various modifications may be made without departing from the spirit and scope of the disclosure. For example, various forms of the flows shown above may be used, with steps re-ordered, added, or removed. Accordingly, other implementations are within the scope of the following claims.

The invention claimed is:

1. A computer-implemented method performed by at least one processor, the method comprising:

receiving, by the at least one processor, a message that includes text data and, in response, dynamically selecting a voice profile to be used by a text-to-speech (TTS) engine to present the text data as speech output, the voice profile including data defining one or more attributes of a machine-generated voice which, when applied by the TTS engine approximate the voice of a particular human, wherein the one or more attributes include at least a pitch, tone, and speed associated with the voice of the particular human, and wherein the message is one of multiple messages as part of a conversation;

presenting, by the at least one processor to a receiving user, at least a portion of the text data as speech output that is generated by the TTS engine employing the one or more attributes of the voice profile;

obtaining, by the at least one processor, feedback data from the receiving user, the feedback data responsive to the receiving user's impression of the speech output, wherein the feedback data comprises biometric data including one or more of the receiving users: heart rate, pulse, perspiration, respiration rate, eye movements, facial movements, facial expressions, or body movements, and wherein the biometric data is indicative of an emotional state of the receiving user during or following the presentation of the speech output; and dynamically modifying, during the conversation and by the at least one processor, at least one of the one or more attributes of the voice profile based on the feedback data from the receiving user by:

detecting a mood or emotional state of the user based on the biometric data; and modifying the voice profile to adapt the voice profile to the mood or emotional state of the user.

2. The method of claim 1, wherein:

the message includes a profile identifier (ID) corresponding to the voice profile to be used to present the text data as the speech output; and selecting the voice profile includes using the profile ID to retrieve the voice profile from data storage.

3. The method of claim 1, wherein:

the message indicates a user identifier (ID) of a sending user; and selecting the voice profile includes using the user ID to retrieve the voice profile from data storage.

4. The method of claim 3, wherein the user ID includes one or more of an email address, a telephone number, a social network profile name, and a gamer tag.

5. The method of claim 1, wherein the one or more attributes of the voice profile further include one or more of a register, and a timbre of the machine-generated voice.

6. The method of claim 1, wherein the voice profile is developed, using a machine learning algorithm, based on speech input from a sending user, and wherein, during each iteration:

the voice profile is used by the TTS engine to generate test speech output; and the voice profile is further developed based on a comparison of the test speech output to the speech input.

7. The method of claim 1, wherein the speech output is presented by a virtual assistant (VA).

8. The method of claim 1, wherein the conversation includes a hybrid text and speech conversation in which a response by the receiving user is received as speech input.

9. A system, comprising:

at least one processor; and a memory communicatively coupled to the at least one processor, the memory storing instructions which, when executed by the at least one processor, cause the at least one processor to perform operations comprising:

receiving a message that includes text data and, in response, dynamically selecting a voice profile to be used by a text-to-speech (TTS) engine to present the text data as speech output, the voice profile including one or more attributes of a machine-generated voice which, when applied by the TTS engine approximate the voice of a particular human, wherein the one or more attributes include at least a pitch, tone, and speed associated with the voice of the particular human, and wherein the message is one of multiple messages as part of a conversation;

presenting, to a receiving user, at least a portion of the text data as speech output that is generated by the TTS engine employing the one or more attributes of the voice profile;

obtaining, by the at least on processor, feedback data from the receiving user, the feedback data responsive to the receiving user's impression of the speech output, wherein the feedback data comprises biometric data including one or more of the receiving users: heart rate, pulse, perspiration, respiration rate, eye movements, facial movements, facial expressions, or body movements, and wherein the biometric data is indicative of an emotional state of the receiving user during or following the presentation of the speech output; and dynamically modifying, during the conversation and by the at least one processor, at least one of the one or more attributes of the voice profile based on the feedback data from the receiving user by:

detecting a mood or emotional state of the user based on the biometric data; and modifying the voice profile to adapt the voice profile to the mood or emotional state of the user.

10. The system of claim 9, wherein:

the message includes a profile identifier (ID) corresponding to the voice profile to be used to present the text data as the speech output; and selecting the voice profile includes using the profile ID to retrieve the voice profile from data storage.

11. The system of claim 9, wherein:

the message indicates a user identifier (ID) of a sending user; and selecting the voice profile includes using the user ID to retrieve the voice profile from data storage.

12. The system of claim 11, wherein the user ID includes one or more of an email address, a telephone number, a social network profile name, and a gamer tag.

13. The system of claim 9, wherein the one or more attributes of the voice profile further include one or more of a register, and a timbre of the machine-generated voice.

14. The system of claim 9, wherein the voice profile is developed, using a machine learning algorithm, based on speech input from a sending user, and wherein, during each iteration:

the voice profile is used by the TTS engine to generate test speech output; and the voice profile is further developed based on a comparison of the test speech output to the speech input.

15. The System of claim 9, wherein the conversation includes a hybrid text and speech conversation in which a response by the receiving user is received as speech input.

16. One or more non-transitory computer-readable media storing instructions which, when executed by at least one processor, cause the at least one processor to perform operations comprising:

receiving a message that includes text data and, in response, dynamically selecting a voice profile to be used by a text-to-speech (TTS) engine to present the text data as speech output, the voice profile including data defining one or more attributes of a machine-generated voice which, when applied by the TTS engine approximate the voice of a particular human, wherein the one or more attributes include at least a pitch, tone, and speed associated with the voice of the particular human, and wherein the message is one of multiple messages as part of a conversation;

presenting, to a receiving user, at least a portion of the text data as speech output that is generated by the TTS engine employing the one or more attributes of the voice profile;

obtaining, by the at least on processor, feedback data from the receiving user, the feedback data responsive to the receiving user's impression of the speech output, wherein the feedback data comprises biometric data including one or more of the receiving users: heart rate, pulse, perspiration, respiration rate, eye movements, facial movements, facial expressions, or body movements, and wherein the biometric data is indicative of an emotional state of the receiving user during or following the presentation of the speech output; and dynamically modifying, during the conversation and by the at least one processor, at least one of the one or more attributes of the voice profile based on the feedback data from the receiving user by:

detecting a mood or emotional state of the user based on the biometric data; and modifying the voice profile to adapt the voice profile to the mood or emotional state of the user.

17. The media of claim 16, wherein:

the message includes a profile identifier (ID) corresponding to the voice profile to be used to present the text data as the speech output; and selecting the voice profile includes using the profile ID to retrieve the voice profile from data storage.

18. The media of claim 16, wherein:

the message indicates a user identifier (ID) of a sending user; and selecting the voice profile includes using the user ID to retrieve the voice profile from data storage.

19. The media of claim 18, wherein the user ID includes one or more of an email address, a telephone number, a social network profile name, and a gamer tag.

20. The media of claim 16, wherein the conversation includes a hybrid text and speech conversation in which a response by the receiving user is received as speech input.

* * * * *